United States Patent [19]

Del Prete et al.

[11] 4,204,440

[45] May 27, 1980

[54] OPEN END ONE WAY TORQUE WRENCH

[76] Inventors: Cosimo Del Prete; Michael V. Ferraro, both of 1048 W. Oakdale, Chicago, Ill. 60657

[21] Appl. No.: 927,282

[22] Filed: Jul. 24, 1978

[51] Int. Cl.[2] ..... B25B 13/28

[52] U.S. Cl. ..... 81/111; 81/179

[58] Field of Search ..... 81/58.2, 111, 179, 186

[56] References Cited

U.S. PATENT DOCUMENTS

| | | | |
|---|---|---|---|
| 1,320,668 | 11/1919 | Askman | 81/179 |
| 1,444,216 | 2/1923 | Sorensen | 81/179 |
| 2,618,996 | 11/1952 | Logan | 81/111 |
| 3,892,150 | 7/1975 | Horton | 81/179 |
| 3,906,822 | 9/1975 | Hertelendy et al. | 81/179 X |

*Primary Examiner*—James G. Smith

*Attorney, Agent, or Firm*—Hill, Van Santen, Steadman, Chiara & Simpson

[57] ABSTRACT

An open end one way torque wrench has a wrench head recess in which a pair of articulated jaw members is adapted to receive and apply torque to a multifaced element by turning the wrench in one direction, and the jaw members automatically release and move into engagement with the next succeeding faces of the element by swinging the wrench in the opposite direction. The wrench head has a substantially semicircular track on which one of the jaw members rides. The other jaw member rides a tangential extension of the track. The jaw assembly is normally biased toward a torquing shoulder from which the assembly retreats during the release and re-engagement action of the jaw assembly.

11 Claims, 10 Drawing Figures

Fig. 2
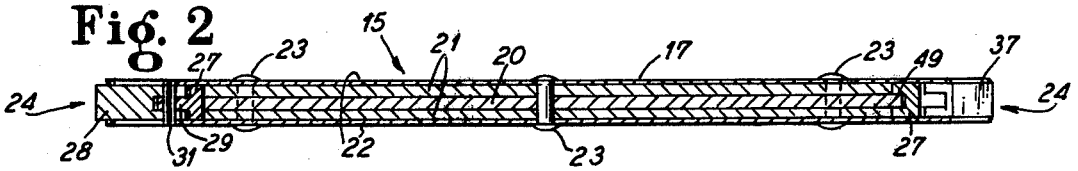
Fig. 1
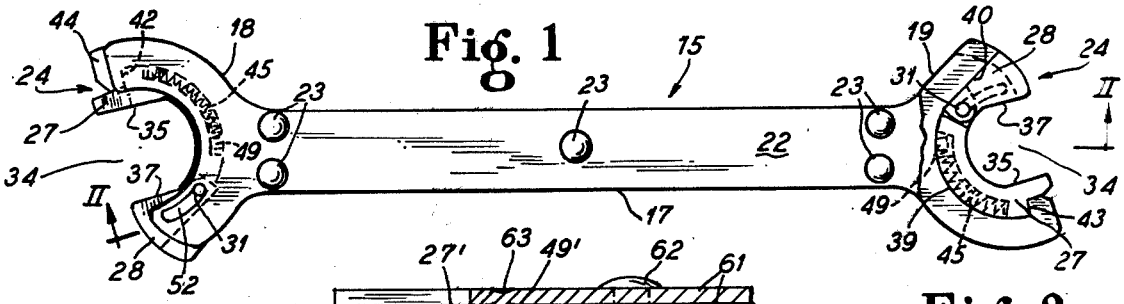
Fig. 8
Fig. 10
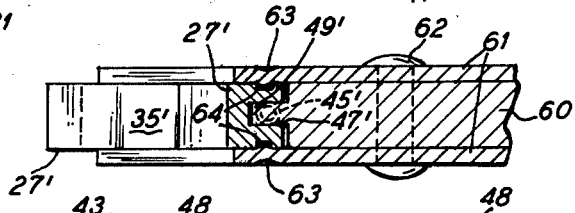
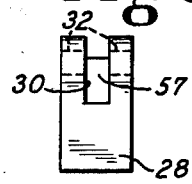
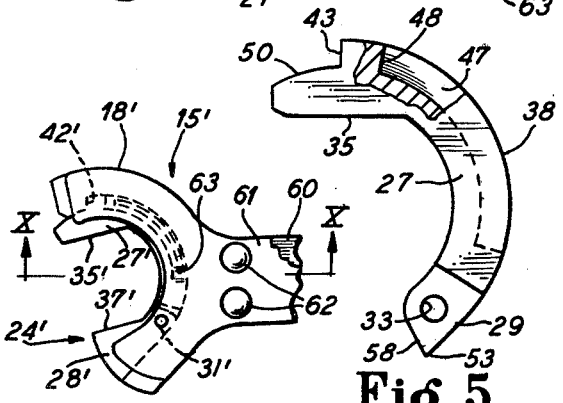
Fig. 9
Fig. 5
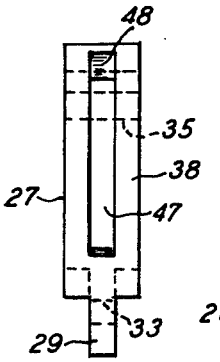
Fig. 6
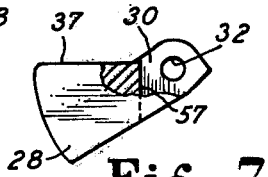
Fig. 7
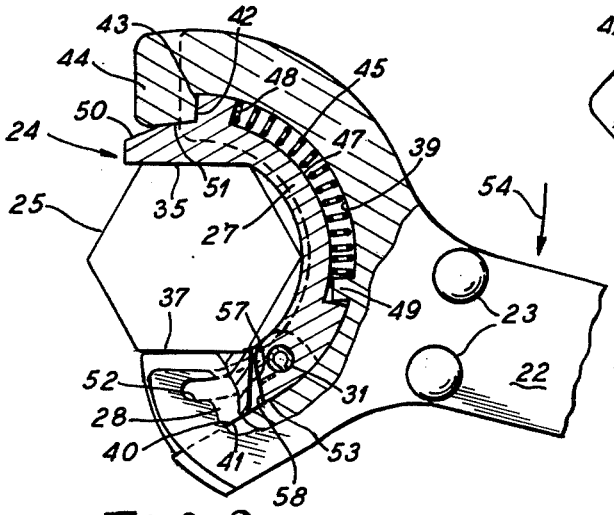
Fig. 3
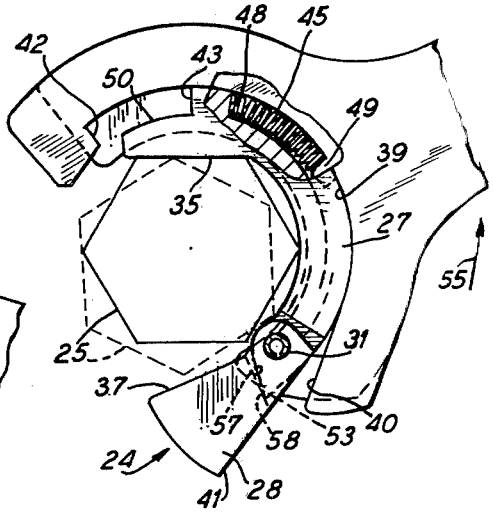
Fig. 4

OPEN END ONE WAY TORQUE WRENCH

This invention relates to torque wrenches, and is more particularly concerned with a new and improved open end one way torque wrench.

So called ratchet wrenches have been known for a long time. Such wrenches generally operate on the principle of a solid jaw member provided with ratchet teeth, and the head of the wrench has one or more ratchets engageable with the teeth so that torque can be applied in one direction and the jaw will remain in place on the element to be torqued while the body and head of the tool are turned in the release direction so that the tool can be again swung in the torquing direction to advance the element such as a bolt or nut in the torquing direction.

Representative of patents of this type are U.S. Pat. Nos. 2,401,128 and 2,551,669. Another type of one way torque wrenches provide individual dogs or jaw members mounted at fixed locations in a jaw recess of the wrench head for gripping the bolt head or nut. Representative of U.S. Pat. Nos. along this line are 2,700,315 and 2,712,259.

In another proposed arrangement of this type of wrench, spring jaw structure is provided as proposed in U.S. Pat. No. 3,059,513.

A major disadvantage of all of the devices of the mentioned patents is that they require small easily damaged parts which even when adequately protected are liable to damage and breakage so that the wrenches are relatively short-lived and may become sloppy in operation due to wear.

An important object of the present invention is to provide a new and improved open end one way torque wrench which will overcome the disadvantages, drawbacks, inefficiencies, shortcomings and problems inherent in prior wrenches of this general type, and which will provide a rugged, low cost efficient long-lived tool.

Another object of the invention is to provide a new and improved open end one way torque wrench having articulated jaws.

An embodiment of the present invention comprises an open end one way torque wrench having a handle body and a wrench head recess at least on one end of said body, and having an articulated jaw assembly in said recess having jaws adapted to grip opposite parallel faces of a multifaced element to which torque is adapted to be applied by swinging the wrench in one rotary direction, and means enabling separating release of said jaw assembly from the gripped faces of said element to engage other faces of the element upon swinging the wrench in the opposite rotary direction. Other objects, features and advantages of the invention will be readily apparent from the following description of representative embodiments thereof, taken in conjunction with the accompanying drawing although variations and modifications may be effected without departing from the spirit and scope of the novel concepts embodied in the disclosure and in which:

FIG. 1 is a side elevational view of a wrench embodying the invention, partially broken away to reveal details of structure.

FIG. 2 is a longitudinal sectional detail view taken substantially along the line II—II of FIG. 1.

FIG. 3 is an enlarged fragmentary side elevational view of one wrench head of the tool of FIG. 1 showing the wrench jaws in torquing relation to an element to which torque is to be applied.

FIG. 4 is a view similar to FIG. 3 but showing how the jaws operate in effecting shift to next succeeding faces of the element being worked on.

FIG. 5 is a side elevational view of one of the jaw elements, partially broken away and in section.

FIG. 6 is a rear elevational view of the jaw element of FIG. 5.

FIG. 7 is a side elevational view of the other of the jaw elements, partially broken away and in section.

FIG. 8 is a rear elevational view of the jaw element of FIG. 7.

FIG. 9 is a fragmentary side elevational view of the wrench head portion of a modified construction of the tool;

FIG. 10 is an enlarged sectional detail view taken substantially along the line X—X of FIG. 9.

An open end one way torque wrench 15 embodying the invention comprises an elongate handle body 17 having at least at one end a wrench head 18, and in the illustrated form comprising a double head wrench having at its opposite end a similar head 19, the difference in the two wrench heads being that they are respectively equipped to work on different sized elements to be torqued. Other than that, each of the heades 18 and 19 is substantially identical to the other and therefore description of one will apply to the other. For example, the wrench head 18 may be adapted for torquing an element such as a hexagonal bolt head or nut of § inch dimension, while the wrench head 19 may be adapted to torque a similar element of half inch dimension. These dimensions are only representative and it will be understood that where desirable a set of wrenches 15 of graduated wrench head sizes may be provided.

In one form, the wrench body 17 may be constructed of a stack of metal stampings comprising a center core stamping 20 (FIG. 2) sandwiched between side core stampings 21, and face plate stampings 22 covering the opposite side faces of the body. The stack of body stampings may be secured together in any suitable fashion such as by means of rivets 23, one such rivet securing the longitudinal center of the stack and two such rivets securing each respective opposite end portion of the stack as best seen in FIG. 1. All of the body stampings cooperate to provide at the opposite ends of the body 17 the respective wrench heads 18 and 19, being for that purpose of suitably larger configuration at the ends of the body.

Each of the wrench heads 18 and 19 is equipped with articulated jaw means 24 for applying torque to a multifaced element such as a square or hexagonal bolt head or nut, for example, element 25 in FIGS. 3 and 4. In a rugged minimum part structure, the jaw means 24 comprises an assembly of a first long jaw member 27 and a second short jaw member 28 which may be investment castings. Means for coupling the jaw members together in articulated end-to-end relation comprise a tongue 29 (FIGS. 5 and 6) on one end of the jaw member 27 received in a complementary clevis slot 30 thereby providing a knuckle connected by a pivot pin 31 extending through aligned pin holes 32 in the clevis parts of the jaw member 28 and a complementary aligned hole 33 through the tongue 29. In a desirable form, the connecting pin 31 is of the expansile drive or spring pin type. In their connected relation, the jaw members 27 and 28 define therebetween an outwardly opening jaw recess 34 with a straight jaw face 35 on the jaw member 27 at one side of the jaw recess 34, and a complementary straight, operationally parallel jaw face 37 on the jaw member 28 at the opposite side of the recess 34.

To permit the jaw members 27 and 28 to function for torquing the element 25 while yet enabling automatic shifting to grip succeeding faces of the element to be torqued, the jaw member 27 is provided with a semicylindrical back bearing surface 38 adapted to ride oscillatably on a complementary semi-circular track 39 provided by a suitable recessed head end portion of the tool body core, as best seen in FIGS. 1, 3, and 4. At opposite ends of the track 39 are means cooperating to maintain the jaw members 27 and 28 in gripping relation to the engaged faces of the element 25 when swinging the wrench in one direction, i.e., the torquing direction, but permitting separating release of the jaw assembly from the gripped faces of the element 25 to engage other faces of the element when swinging the wrench in the opposite or repositioning direction. For this purpose one end the track 39 terminates in a substantially straight tangential extension surface 40 against which a substantially straight back surface 41 of the jaw member 28 engages. At its opposite end, the track 39 terminates at an inwardly facing torquing stop shoulder 42 arranged to be engaged by a complementary generally outwardly facing torque shoulder 43 formed on the adjacent end of the jaw member 27. It may be observed that in the area of the stop shoulder 42, the wrench head core has a fairly massive strain resistant torque thrust receiving spanner wrench-like lug structure 44.

Means are provided for normally biasing the articulated jaw assembly 24 toward the stop shoulder 42. Conveniently this comprises a small diameter coiled compression spring 45 accommodated within an arcuate groove 47 in the back of the longer jaw member 27. At one end, the spring 45 thrusts against a shoulder 48 at the end of the groove 47 near but spaced from the torque thrust shoulder 43. At its opposite end, the biasing spring 45 thrusts against a fixed stop lug 49 fashioned for this purpose integrally with the central core stamping member 20 and dimensioned to be received freely in the groove 47. When assembling the parts, the biasing spring 45 is placed under sufficient compression to normally bias the articulated jaw assembly toward the torque shoulder 42. On the other hand the spring 45 is of sufficiently open coil structure to permit a substantial range of compression to permit a substantial degree of riding of the jaw assembly away from the shoulder 42 as exemplified in FIG. 4. Such riding movement of the jaw assembly is facilitated by shaping a suitable radius surface 50 on the back edge of the jaw member 27 which projects forwardly or outwardly beyond the shoulder 43 and substantially conformable to a complementary concavely curved back up surface 51 on the confronting shoulder lug portion 44 of the wrench head.

To retain the articulated jaw assembly 24 within the wrench head recess in which the assembly is mounted, the cover plates 22 projects sufficiently beyond the track surfaces 39 and 40 to lap the opposite sides of the jaw members 27 and 28 in slideable retaining relation. The lapping retaining head portions of the cover plates 22 are adequately recessed, as best seen in FIG. 1, to clear the jaw recess 34 so as to avoid any interference with handling of the element 25 in the jaw recess. In addition, the lapping head portions of the plates 22 serve to retain the jaw assembly 24 against outward displacement relative to the track 39, being for this purpose provided with complementary matching arcuate guide slots 52 within which the opposite end portions of the articulating and coupling pin 31 engage in free slideable relation during arcuate movements of the jaw assembly in use of the wrench. As a resistance to any tendency of biasing spring thrust to swing the longer jaw member 27 outwardly about the pivot provided by the pin 31, the terminal portion of the jaw member 27 adjacent to the pin 31 is provided with a tail projection 53 which engages the inner end of the tangential surface 40 in the at rest fully biased position of the jaw assembly.

In use of the wrench 15, the element 25 to be torqued is received in the jaw recess 34 with the jaw surfaces 35 and 37 engaging corresponding faces of the element 25. By swinging the tool in the direction indicated by the arrow 54, that is clockwise as shown in FIG. 3, a firm torquing grip is maintained on the element 25 and torque applied to the extent desired or permitted by available space. Then, in order to engage other or succeeding faces of the element 25, reverse swinging of the tool as indicated by the arrow 55 in FIG. 4, automatically effects release and regripping of the element 25, assuming, of course, that the element 25 is held against reverse rotation. As the wrench is swung in the counterclockwise direction shown in FIG. 4, opposite corners of the element 25, as shown in dash outline in FIG. 4, thrust the jaw surfaces 35 and 37 apart causing the generally triangularly shaped shorter jaw member 28 to initially ride out along the surface 40 together with arcuate riding of the jaw member 27 away from the shoulder 42 along the track 39. As such riding progresses, the jaw member 28 opens relative to the jaw member 27, substantially as shown, whereby full release of the previously gripped faces of the element 25 occurs, and the jaws move toward gripping position with respect to the next succeeding faces of the element 25 to be gripped for torquing, this being schematically indicated by the full line position of the element 25 in FIG. 4. The torquing maneuver can then be repeated, because the biasing spring 45 tends to return the articulated jaw assembly to the torquing position in the wrench head, and in any event the direction of swinging of the tool will be again in the direction of the directional arrow 54 in FIG. 3. In order to avoid overswinging of the jaw member 28 after it has swung open far enough to fully release the element 25, a stop shoulder 57 on the member 28 at the inner end of the clevis slot 30 engages a complementary stop shoulder 58 on the adjacent end of the jaw member 27. There is, of course, adequate loss motion normal clearance between the shoulders 57 and 58 to permit full opening release of the jaw member 28 relative to the jaw member 27 during the reverse or retracking movement of the jaw assembly during return swinging of the tool.

Instead of constructing the core of the body of the wrench from a stack of metal stampings, the body core may be constructed as a one piece forged core 60 as shown in FIGS. 9 and 10, with stamped sheet metal facing plates 61 secured to the opposite faces of the core 60 as by means of rivets 62. In such construction, the articulated jaw assembly 24' may be substantially the same as the jaw assembly 24 already described and therefore primed reference numerals are intended to apply to common elements. Instead of using the connecting pin 31' of the jaw assembly as a retaining structure for the jaw assembly, aligned inwardly projecting retainer dimples 63 are formed in the jaw member lapping portions of the face plates 61 and projecting into opposite arcuate grooves 64 in the faces of the longer jaw member 27'. Otherwise the structure and operation of the wrench head and jaw assembly is the same as described in connection with the form of FIG. 1.

It will be understood that variations and modifications may be effected without departing from the spirit and scope of the novel concepts of this invention.

We claim as our invention:

1. An open end one way torque wrench having a handle body and a wrench head recess at least on one end of said body and receptive of a multifaced element to be torqued, and comprising:

a substantially semicircular track defined in said recess;

a jaw assembly having a pair of jaw members within said recess and adapted to grip opposite parallel faces of the multifaced element to which torque is adapted to be applied;

means connecting said jaw members in end-to-end articulated relation to one another;

means for operatively retaining said jaw members in said recess and permitting oscillation of said jaw members with respect to said track;

and means for maintaining said jaw members in a rigid position, element face gripping relation when the wrench is swung in one rotary direction, and permitting oscillation movement away from said rigid position and into a separating release relation of said jaw members from the gripped faces of the element for shifting of the jaw members into engagement with other faces of the element upon swinging of the wrench in the opposite rotary direction.

2. A wrench according to claim 1, wherein one jaw member is of substantial length, the other jaw member being pivotally coupled to said one jaw member, said retaining and enabling means comprising a shoulder at one end of said track engageable as a stop by said one jaw member in said rigid position and a substantially tangential extension at the opposite end of said track, and said other jaw member having a bearing surface complementary to and engaging said substantially tangential extension and movable along said extension into said separating release relation in said oscillating movement away from said rigid position.

3. A wrench according to claim 1, including torque shoulder means at one end of said track, and means normally biasing said jaw assembly towards said torque shoulder means.

4. A wrench according to claim 1, wherein said connecting means comprises a knuckle connecting said jaw members.

5. A wrench according to claim 4, wherein said knuckle includes a connecting pivot pin serving as part of said retaining means, and said retaining means further having structure on said handle body cooperating with said pin to retain the jaw assembly against displacement from said recess.

6. A wrench according to claim 1, wherein said handle body comprises a core structure, face plates on opposite sides of said core structure, and said retaining means including portions of said face plates for retaining said jaw assembly in said recess.

7. A wrench according to claim 1, wherein said jaws comprise a pair of complementary castings, and cooperating knuckle structure on said castings providing said connecting means for connecting said castings in said end-to-end articulated relation.

8. An open end one way torque wrench having a handle body and a wrench head recess at least on one end of said body and receptive of a multifaced element to be torqued, and comprising:

a substantially semicircular track in said recess having at one end a relatively short substantially tangential terminal portion;

a stop shoulder at the opposite end of said track;

a jaw assembly comprising a first jaw member having a substantially semicylindrical bearing surface engaging said track, and a second shorter jaw member having a bearing surface engaging said substantially tangential portion;

means pivotally connecting said jaw members;

biasing means normally biasing said first jaw member towards said shoulder;

said first jaw member having a torque shoulder separably engaging said stop shoulder;

means retaining said jaw assembly in said recess;

and said jaw members having complementary jaw surfaces for engaging faces of said element;

said shoulders engaging and enabling torque to be applied by the wrench for turning said element upon swinging of the wrench in direction generally towards said terminal portion, and said biasing means yielding to permit the articulated jaw assembly to ride said track away from said stop shoulder when the wrench is swung in the opposite rotary direction whereupon said second jaw member moves outwardly relative to said tangential surface and is adapted to swing open relative to said first jaw embers for releasing said element and permitting shifting of the jaw elements to engage other faces of the element for repetition of the application of torque by swinging of the wrench in said rotary direction toward said terminal portion.

9. A wrench according to claim 8, including complementary stop shoulder means on said jaw members to prevent overswinging of the smaller jaw member in the jaw opening movement thereof.

10. A wrench according to claim 8, wherein said handle body comprises a core structure, face plates on opposite sides of said core structure, and said retaining means includes structure on said face plates.

11. A wrench according to claim 10, wherein said retaining structure of said face plate provides arcuate guide slots, and said connecting means comprises a pivot pin having opposite end portions engaged in said guide slots.

* * * * *